United States Patent [19]

Shanks et al.

[11] Patent Number: 4,693,340

[45] Date of Patent: Sep. 15, 1987

[54] BUMPER GUIDE ASSEMBLY FOR ELEVATOR DOORS

[76] Inventors: Ernest R. Shanks, 6990 S. Steele St., Littleton, Colo. 80122; Gerald L. Carnes, 6752 E. Exposition Ave., Denver, Colo. 80224

[21] Appl. No.: 781,695

[22] Filed: Sep. 30, 1985

[51] Int. Cl.[4] ..... B66B 13/08; B66B 13/26

[52] U.S. Cl. ..... 187/52 R; 187/56; 187/DIG. 1; 49/27

[58] Field of Search ..... 187/56, 51, 52 R, 62, 187/DIG. 1; 49/27, 28

[56] References Cited

U.S. PATENT DOCUMENTS 3,168,165 2/1965 Bagnasco ..... 49/27 X 4,227,592 10/1980 Foreman et al. ..... 49/27 X

*Primary Examiner*—H. Grant Skaggs

*Assistant Examiner*—Nils E. Pedersen

[57] ABSTRACT

This invention relates to a realignment assembly for use with a modern passenger elevator cab door for attachment to the opposed mechanically-actuated bumper switches that automatically reopen the doors when the closure thereof is obstructed, such assembly comprising a slotted member defining a horizontally-disposed guideway paralleling the reciprocating movement of the bumper switches and an arm slidably mounted within the slot in the guideway and attached to the adjacent bumper effective to move therewith and prevent said bumper from deflecting into the path of an electric eye beam alongside thereof which is also part of a second system operative to reopen the doors when interrupted. The guide member also preferably includes a faceplate spring-biased against the guide rod in a direction to force the latter out of the path of the light beam emanating from the electric eye system transmitter.

2 Claims, 4 Drawing Figures

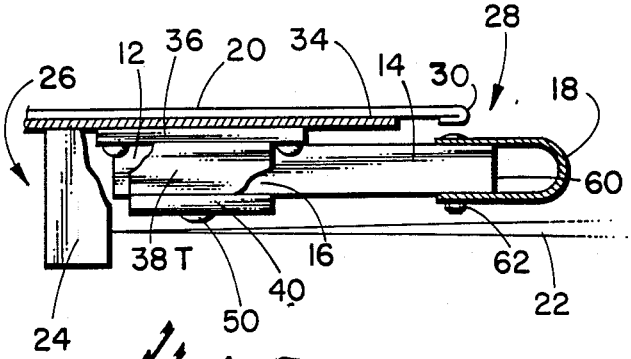
Fig. 3
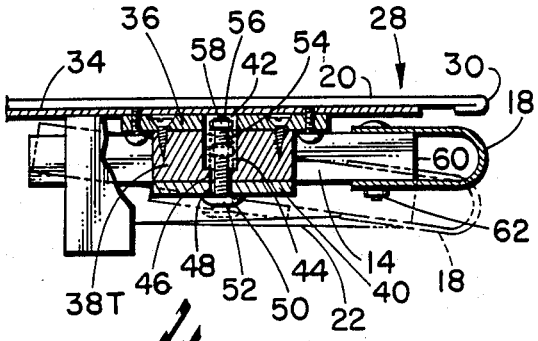
Fig. 4
Fig. 1
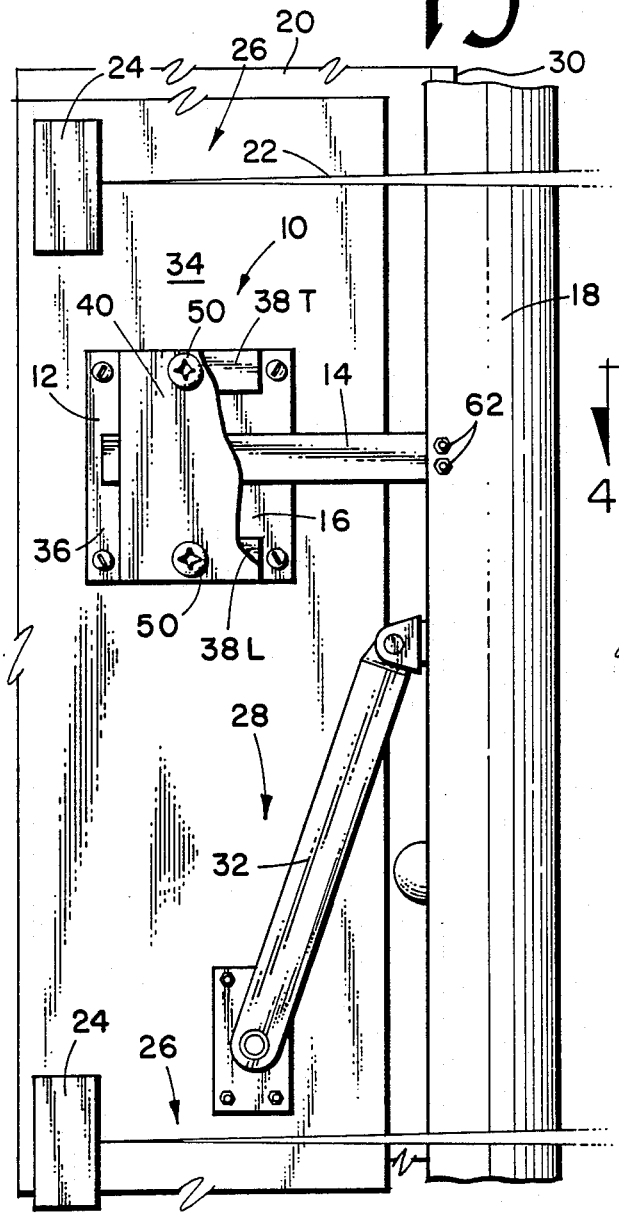
Fig. 2
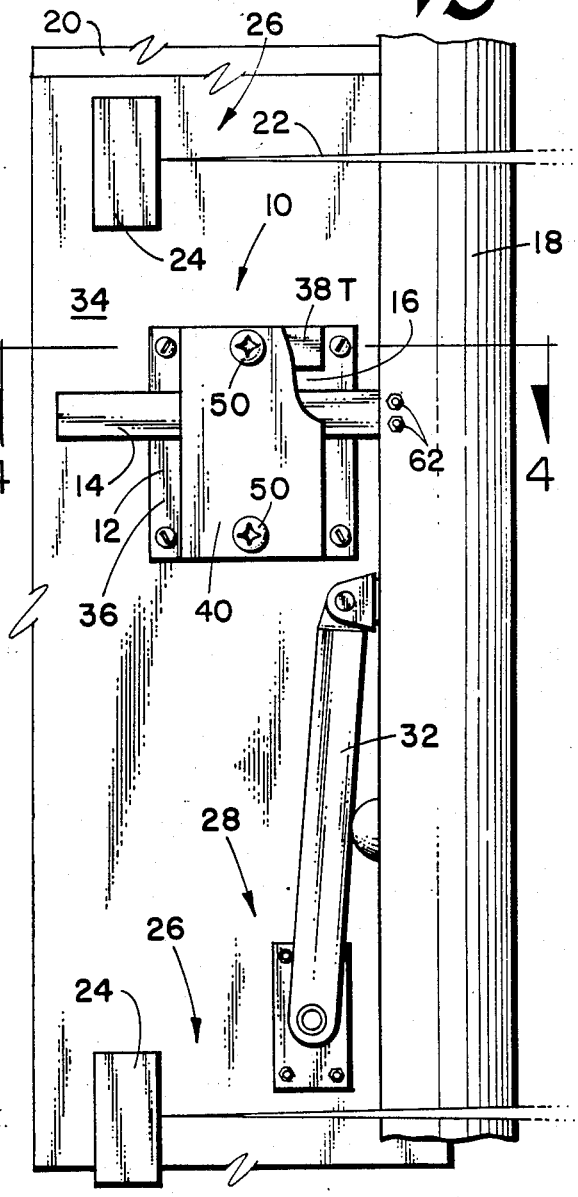

BUMPER GUIDE ASSEMBLY FOR ELEVATOR DOORS

Most, if not all, modern passenger elevator doors are of an open-faced metal construction to the main panel of which is attached both the actuating mechanism and generally two independently-operative safety mechanisms. In some designs, the doors overlap one another and telescope from a closed position covering the cab entryway to an open position retracted alongside thereof. Other designs have the doors moving from side-to-side in a common plane between a closed position in which their adjacent edges abut one another and an open position retracted along opposite sides of the cab entryway. Regardless of which design is used, they can be made to accommodate one or both of the safety mechanisms which are automatically operative to reopen both the cab and hallway doors when an object, usually a passenger or some part of his or her body, moves into position therebetween while they are either open or in the process of closing.

One such system customarily consists of an electric eye which directs a beam of light from a transmitter mounted upon a panel of the cab door out past the bumper of the second safety mechanism to a receiver arranged in opposed relation on the opposite side of the entryway. Interruption of this light beam is instantly effective to trigger an electrical circuit of conventional design which operates to reopen the doors. Some such systems include two sets of transmitters and receivers, one pair set about knee high with the second around chest high.

The second of the two systems is a mechanically-actuated one in which bumper switches mounted for reciprocal movement adjacent the cab door edge and projecting laterally therebeyond are similarly effective upon actuation to reopen both the cab and hallway doors. The parallel doors which move laterally to and fro each contain such a switch while the telescoping ones usually have only one moving with the door that engages the jamb. Regardless of which arrangement is used, when engaged by an object that moves one or both of the bumpers from extended into retracted position, they close a switch to activate the door-reopening circuit.

Now the problem that has arisen with double safety systems of this type is that the mechanical mechanisms which mount the bumper for reciprocating movement upon the panels of the cab door become worn to the extent that the bumpers themselves no longer move sideways in the plane in which they are designed to move, but instead, they deviate to the side where the light beam of the electric eye is passing. When this occurs, the light beam is interrupted to the extent that the door reopening circuit is actuated and the doors remain open thus disabling the elevator even though no obstruction other than the bumper itself is actually present. Actually, the doors tend to "chatter" as the reopening switch is repeatedly actuated and deactuated. In any event, the solution is one of disconnecting the electric eye circuit until a serviceman arrives who can repair the door by replacing the worn parts that allowed the bumper to deviate in the first place. Obviously, this is seldom accomplished quickly and, in the meantime, the elevator is either out of service entirely or at least disabled to the extent that one of its two safety systems is inoperative.

It has now been found in accordance with the teaching of the instant invention that this annoying problem can be eliminated by the simple, yet unobvious, expedient of mounting a guide member having a horizontally-disposed guide slot therein on the panel of the cab door and connecting a guide bar to the bumper for guided movement to and fro within the guide slot such that the bumper is prevented from turning aside into the path of the light beam transmitted from the electric eye transmitter. The conventional mounting of the bumpers on a vertically-spaced pair of pivot arms is such that the bumpers raise up slightly as they are actuated from extended into retracted position. This being the case, it is necessary that the slot in the guide member be somewhat wider than the width of the guide rod so as to allow it to move in an arcuate path along with the bumpers and thus raise up a bit while it remains essentially horizontal as installed. The faceplate covering the slot in the guide member is preferably spring-biased to yield slightly thus widening the slot so as to accommodate some side to side movement of the bumper as it moves between its extended and retracted positions but, most important, bias the guide rod and bumper attached thereto out of the path of the electric eye light beam.

It is, therefore, the principal object of the present invention to provide a novel guide system for the bumper switches of elevator cab doors effective to prevent the latter from deflecting laterally into the path of the light beam emanating from the electric eye triggered door-opening system that would cause it to actuate unnecessarily.

A second objective of the invention herein disclosed and claimed is the provision of a device of the type aforementioned which is adaptable for use with both center-closing double doors that operate in the same plane and telescoping doors that overlap and close against a jamb on one side thereof.

Another object of the within-described invention is to provide a guide system that does not interfere in any way with the normal operation of the cab or hallway doors or the safety systems incorporated therein.

Still another objective is the provision of an elevator door bumper guide that compensates and corrects for wear in the mounting assembly that is designed to allow them to reciprocate between an extended and a retracted position without deviating from side to side but oftentimes permits this to happen after repeated actuations.

An additional object is to provide a yieldable biasing subassembly in the guide member automatically operative to push the guide rod and associated bumper out of the path of the light beam transmitted to the receiver of the electric eye triggered door-opening system.

Further objects of the invention are to provide a elevator door bumper alignment system which is simple, inexpensive, versatile, easy to install, lightweight and rugged.

Other objects will be in part apparent and in part pointed out specifically hereinafter in connection with the description of the drawings that follows, and in which:

FIG. 1 is a fragmentary front elevation showing portions of both the optically and mechanically-actuated systems for reopening both the elevator cab and hallway doors when an object interferes with the closure thereof in extended position along with the bumper guidance system of the present invention that prevents the latter from interfering with operation of the former;

FIG. 2 is a fragmentary front elevation showing the same elements as in FIG. 1 but actuated into retracted position;

FIG. 3 is a fragmentary view, portions of which have been broken away and shown in section; and, FIG. 4 is a fragmentary section taken along line 4—4 of FIG. 2 showing in phantom lines, in addition to what can be seen in FIG. 2, what happens when the bumper becomes misaligned into the path of the light beam and how the spring-biased plate on the front of the guide member is automatically operative to restore same to its properly aligned position.

Referring next to the drawings for a detailed description of the present invention, reference numeral 10 has been selected to broadly designate a guidance system consisting of a guide member 12 and an arm 14 slidably mounted for reciprocating movement within a slot 16 in the latter which when connected as shown to the bumper 18 mounted in the conventional way upon an elevator cab door 20 becomes effective to prevent this bumper from becoming misaligned to the extent shown in phantom lines in FIG. 4 where it interrupts the light beam 22 emanating from a transmitter 24 that also functions to automatically reopen it along with the hallway doors when an object is interposed that prevents it from reaching its receiver (not shown) located in the path thereof. More specifically, FIG. 3 shows the outline of a conventional elevator cab door of the common type housing both an optically-triggered safety system indicated in a general way by reference numeral 26 and a mechanically-triggered one similarly designated by reference numeral 28. In the mechanically-triggered one, a generally channel-shaped bumper projects as shown in FIG. 3 out beyond the leading edge 30 of the cab door 20 where it will be engaged by an article inserted between two such doors closing toward one another in abutting relation or, alternatively, telescoping panels of a single door closing against a fixed jamb (neither of which has been shown). Where two such cab doors are used as the closure for the elevator cab, a second mechanical mechanism of the same type is provided on the other cab door so that regardless of which bumper is engaged, both doors will reopen along with the hallway doors. In the case of the optically-actuated system, on the other hand, the receiver (not shown) is housed in either the second of the two cab doors or the jamb. While a second optical system is customarily used, it is not placed in the other of the two cab doors but rather at a different height as shown in FIGS. 1 and 2 so that a child or other person who might be too short to interrupt the beam of the upper one will surely do so to the lower one. There is, of course, a second complete set of hallway doors that have not been illustrated that cover these cab doors and close in delayed relation thereto if nothing actuates either of the two different types of safety systems.

In the mechanical system 28, the bumpers are pivotally attached to upper and lower pivot arms 32, only the lower of which has been illustrated, for limited arcuate pivotal movement thereon between the extended or deactuated position of FIGS. 1 and 3 and the retracted or actuated position of FIG. 2. The upper arm of the system carries the switch and other elements of the electrical circuit (not shown) which functions upon actuation to reopen both the cab doors and the hallway doors. This same door reopening circuit is connected to the optically-actuated system 26.

Now, the problem which arises is that the mountings for the bumpers 18 become worn due to repeated actuations to the degree where they become misaligned and deflect to one side a distance which allows them to interrupt the light beam of the optical system thereby actuating the latter so as to keep the doors from closing even though, as a matter of fact, there is nothing in between them. With the doors open, of course, the elevator itself is rendered inoperative and the whole system is effectively shut down. To put the elevator back in operation, the only recourse available until the bumper misalignment can be corrected is to disconnect the optical system. To do so, obviously, creates somewhat of a hazardous condition when one of the safety systems designed to prevent accidents is rendered completely inoperative.

Applicant's solution to the problem involves mounting the guide member 12 to the cab door 20 on a panel 34 which moves therewith and upon which is also customarily mounted the supporting hardware for both of the conventional door reopening safety systems already discussed. As illustrated, this guide member consists of a backing plate 36 which is bolted or otherwise secured to panel 34 of the cab door 20, upper and lower spacer bars 38L and 38T running along the top and bottom edges of the backing plate so as to leave ample vertical separation therebetween for the reception of guide bar 14. Coverplate 40 bridges the gap thus formed between the spacers and cooperates therewith and with the backing plate to complete guideslot or track 16. In the preferred embodiment of the invention illustrated in FIG. 4, the faceplate is yieldably mounted atop the spacers so that it can accommodate some tilt from side-to-side in the guide bar as shown but, at the same time, will bias the latter along with the bumper attached thereto back into aligned position out of the way of the light beam 20. This is simply accomplished by counterboring slightly oversize openings 42 and 44 through the backplate and into the backside of the spacers coaxially aligned with smaller openings 46 in the front thereof and aligned opening 48 through the faceplate. Fastener 50 with a head 52 is then passed through the aligned openings 42 through 48, a compression spring 54 is mounted on the projecting shank 56, and an abutment-forming member 58 is fastened to the shank to keep the spring in place. If the shank 56 of the fastener is threaded as shown, then a nut can be used as the abutment-forming member thereby rendering the system adjustable as to the biasing force exerted by the spring.

The width of slot 16 as measured by the thickness of the spacers is essentially the same as the thickness of the guide bar so that the latter is slidable therein with a free-sliding fit. One free end 60 of the guide bar is fastened with suitable fasteners 62 inside the channel of the bumpers as seen in FIGS. 3 and 4 so as to not obstruct the light beam 20 but move alongside thereof as intended. The height of the slot 16 and the placement of the guide rod therein spaced away from both the upper and lower spacers in actuated as well as deactuated position insures that it can raise up slightly as the bumper retracts without hitting either one. Thus, even though the mounting hardware for the bumper becomes quite loose and worn, the bumper guide assembly just described stabilizes its movement and prevents it from deflecting into the path of the electric eye beam. Lightweight and low cost plastic parts can be used advantageously for all but the springs and fasteners. Installation is simple and straightforward for even unskilled persons and can be accomplished with a minimum of downtime where the elevator is out of service.

What is claimed is:

1. For use in an elevator cab door of the type mounting both an electric-eye-triggered optical system and a bumper-triggered mechanical system positioned alongside one another, said systems each being independently operative to actuate a mechanism to open the door when the latter is obstructed, and wherein the bumper of the mechanical system whose function it is to actuate the door-opening mechanism as it moves from its retracted operative position into its extended inoperative position may upon becoming misaligned interrupt the light beam generated by the optical system thus causing the door-opening mechanism to actuate and keep the door open even through unobstructed, the guidance assembly for keeping the bumper aligned and out of the way of the light beam which comprises: a rigid arm attachable to the bumper of the mechanical system for reciprocating movement therewith between its extended and retracted positions and a slotted housing attachable to the cab door for movement therewith, said housing including front and rear guide members with upper and lower spacers positioned therebetween all cooperating to define a side-opening guide slot positioned and adapted to slidably receive the arm and maintain same together with the bumper attached thereto aligned out of the path of the light beam during the excursion thereof between its retracted and extended positions; and, spring means yieldably biasing the front guide member into spaced substantially parallel relation to the rear guide member.

2. The bumper guidance assembly as set forth in claim 1 in which: the spring means comprise upper and lower tension springs connected between the front guide member and the upper and lower spacers, said springs normally biasing said front guide member into face-to-face contacting relation with said spacers.

* * * * *